United States Patent [19]

Johnson

[11] 3,944,231

[45] Mar. 16, 1976

[54] GOLF CLUB

[76] Inventor: Harold T. Johnson, 706 Pleasant St., Kewanee, Ill. 61443

[22] Filed: Mar. 3, 1975

[21] Appl. No.: 554,794

[52] U.S. Cl. ..... 273/162 E; 273/162 F

[51] Int. Cl.[2] ..... A63B 53/04

[58] Field of Search ..... 273/77 R, 80 C, 162 R, 273/162 E, 163 R, 164, 167–175; D34/5 GC, 5 GH; 294/19 A

[56] References Cited

UNITED STATES PATENTS

| | | | |
|---|---|---|---|
| 2,213,190 | 9/1940 | Haverbach | 294/19 A |
| 3,064,975 | 11/1962 | Smith | 273/162 E X |
| 3,185,483 | 5/1965 | Klynman | 273/162 R X |
| 3,224,781 | 12/1965 | Hutchison | 273/162 E |
| 3,632,112 | 1/1972 | Jacobs | 273/162 E |
| D195,135 | 4/1963 | Green | D34/5 GH |
| D211,374 | 6/1968 | Hanson | 273/167 D X |
| D217,483 | 5/1970 | Jackson | 273/162 E X |
| D226,568 | 3/1973 | Morris | 273/167 D X |
| D231,375 | 4/1974 | Solheim | D34/5 GH |

FOREIGN PATENTS OR APPLICATIONS

| | | | |
|---|---|---|---|
| 29,603 | 12/1913 | United Kingdom | 273/167 F |

OTHER PUBLICATIONS

"Wittek Golf Range Supply Co."; 1971; pp. 46 & 47.

*Primary Examiner*—Richard J. Apley

[57] ABSTRACT

A golf glub comprising a shaft and a head in which the head has a relatively flat front surface for striking the ball and a rear surface that is composed of a ball-receiving pocket between the shaft and the toe of the club. The club is further characterized by having an upwardly facing arcuate surface on the heel portion of the head terminating in a relatively narrow or small section so that the arcuate surface may engage and hold a flag pole that is lying on the ground. The club is further characterized by having a marking on the top side of the head which indicates the center of the club with respect to the weight distribution of the head. The latter marking indicates the part of the head that should strike the ball.

7 Claims, 6 Drawing Figures

GOLF CLUB

BACKGROUND OF THE INVENTION

Golf is becoming a more popular sport in the United States and throughout the world and it is particularly becoming more popular with older people who find it difficult to stoop to pick up the golf ball and flag after a ball has been placed in the hole. There are certain ailments that make it difficult for older people, and in some instances younger people, to stoop to do these chores. When playing golf, there are only two areas where a player must stoop to handle the ball and flag, one being on or about the green and the other being on the tee. It is the primary purpose of the present invention to eliminate the required stooping to pick up the golf balls and the flag in and about the green.

SUMMARY OF THE INVENTION

It is the primary purpose of the present invention to provide a golf club that has a vertically disposed front putting surface that contacts the ball and which has a rear surface with a recessed portion between the toe of the club and the shaft of the club that will hold a golf ball when the club is slightly tilted and the ball is forced into the recess. It is also an object of the invention to provide on the heel end of the putter a small hook-type extension that will slide under a flagpole laying on the ground so that the pole and golf club can be raised to the player's hand height.

It is a further object of the invention to provide on the above-described putter a marking on the top side of the putter which will indicate the location of weight balance so that the club can strike the ball at the mark. Due to the recessed backside of the putter as aforedescribed and to the hooked-shaped heel portion of the putter, the overall center of weight distribution is not easily determined by viewing the club. Consequently, it is believed necessary to provide this marking on the top of the club.

DESCRIPTION OF THE PREFERRED EMBODIMENT

Figures 1, 2, 3, 4, 5, 6:
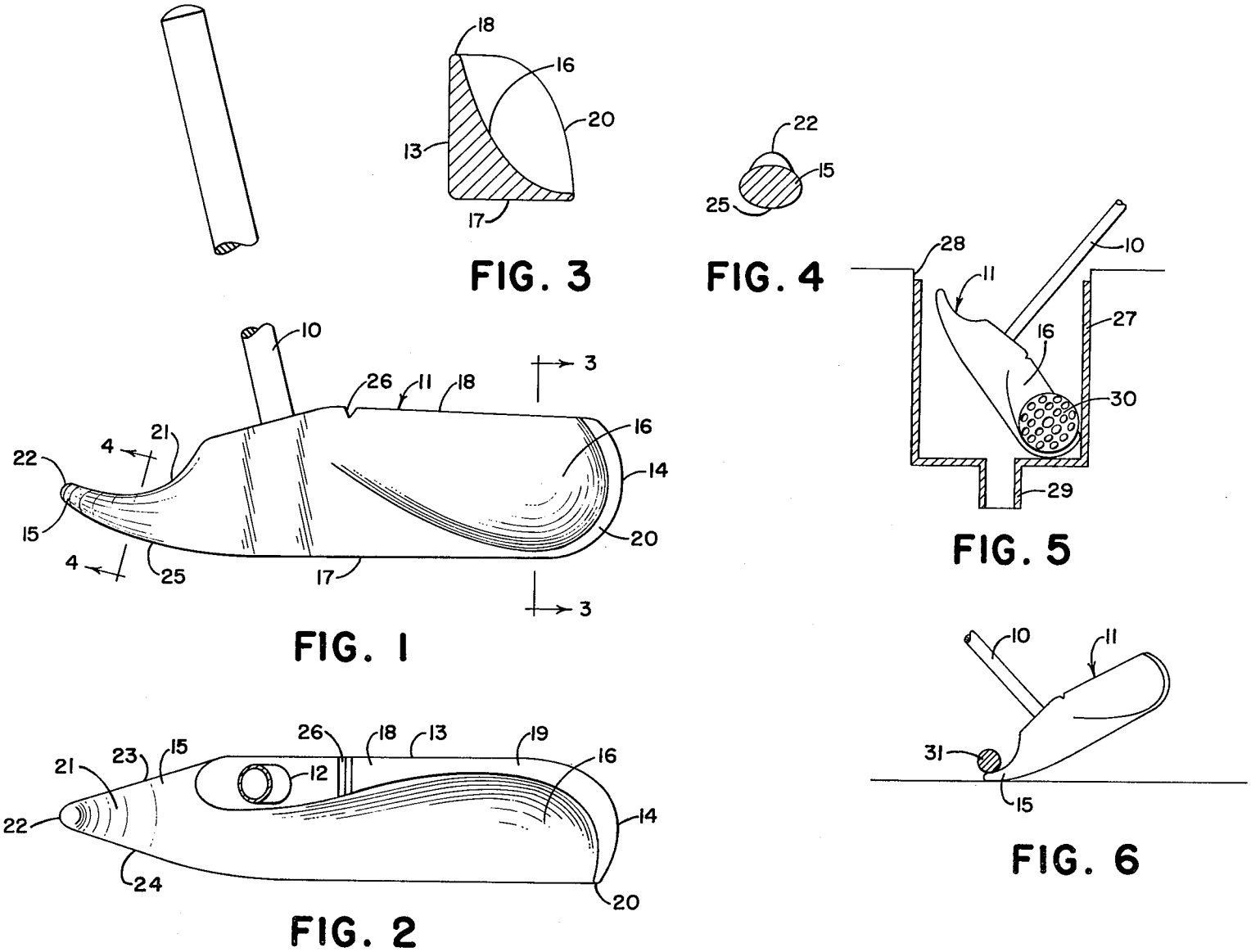
FIG. 1 is a view taken from the rear side showing the head of a putter and a portion of the golf club shaft.
FIG. 2 is a plan view of the golf club portion shown in FIG. 1.
FIG. 3 is a sectional view taken substantially along the line 3—3 of FIG. 1.
FIG. 4 is a sectional view taken substantially along line 4—4 of FIG. 1.
FIG. 5 is a view showing the club of the present invention in use when removing a golf ball from the cup, the latter being shown in section.
FIG. 6 is a view showing the club in use when hooking a pole laying on the ground.

Referring first to FIGS. 1–4, the putter is is composed of a conventional golf club shaft 10 and golf club putter head 11. A shaft opening 12 is provided in the head 11 for receiving the shaft 10. As in conventional, the putter head 11 has a relatively flat generally vertical side 13 that is the surface that normally strikes the golf ball. The head 11 has a toe portion 14 and a heel portion 15 disposed on opposite sides of the shaft opening 12. The head 11 has a ball-receiving cavity, indicated in its entirety by the reference numeral 16, on the rear or trailing surface and generally between the toe 14 and the shaft opening 12. The dished cavity 16 on the rear surface of the head 11 extends generally between the lower surface 17 and the upper surface 18 of the putter head as may be seen from viewing FIGS. 2 and 3. The bottom side 17 is generally horizontal and is relatively wide as compared to the top surfacd 18. The top surface 18 is relatively wide at the shaft opening 12 and from there narrows to a relatively arcuate-shaped thin-lipped section 19 midway between the shaft opening 12 and the toe 14 and from thence rearwardly to a rear lipped section 20 extending vertically arcuately around the toe and from there downwardly around the lower corner of the toe end to the lower surface 17. The cavity or pocket 16 generally opens rearwardly and upwardly when the club is in a vertical disposition. The cavity 16 may therefore be defined by an arcuate-shaped surface that in a vertical direction extends from a rear edge of a relatively wide bottom side 17 of the head to the relatively thin sections 18, 19 of the top side, and in a lengthwise direction the arcuate-shaped cavity 16 extends from a relatively thin-lip 20 at the toe 14 first forwardly and then rearwardly to the area of the shaft opening 12.

The heel 15 on the putter head 11 has an upwardly facing arcuate surface 21 that begins adjacent the shaft opening 12 and extends therefrom first downwardly and then outwardly toward a point portion 22. Sides 23, 24 of the heel portion 15 converge toward one another and toward the point 22 and from the forward surface 13 and from the rear side 16 respectively. The sides 23, 24 generally begin just to the heel side of the opening 12. The underside of the heel portion 25 sweeps upwardly from the bottom surface 17 and tapers with respect to the surface 21 toward the point 22. As may be best seen from viewing FIG. 1, it is here that the heel portion 15 generally forms an upwardly opening hook-like portion that will receive a flagpole.

Due to the rather unconventional shape of the golf club head 11, it may be difficult for some golfers to locate the center of gravity of the entire club. To help in this matter, there is provided an edge or side 18 of the head a fore-and-aft extending notch 26. As is clearly evident, the golfer will approach the ball in the swing of the putter and attempt to strike the ball by the surface 13 substantially at the location of the notch 26. This will help the golfer in providing a true or straight putt.

Referring to FIG. 5, the use of the putter in retreiving the golf ball from a conventional cup is shown. The cup has a metal liner 27 that is inserted in an hole opening 28 and a downwardly depending tube or pipe 29 which receives the lower end of the flagpole. After putting the ball into the hole or cup 27, the putter may be inserted so that the shaft 10 is tilted in such a manner that the lip 20 at the toe end and the underside of the rear surface 16 is placed under the ball. The shaft 10 may then be raised and the ball 30 held in the cavity 16. The ball 30 is then removed by the golfer when the club is raised to the height of his hands.

Referring to FIG. 6, the flagpole 31 normally lies on the ground and due to the flag and the ringlets that hold the flag on the club, it will not engage the ground. By properly tilting the shaft 20, the tip 22 may be inserted under the flagpole 31 until it sits in the upwardly opening arcuate surface 21. The club may then be raised to the height of handling by the golfer so that it can then be replaced in the cup 27.

A golf ball does not necessarily have to be in a cup for it to be picked up by the cavity 16. After a few practices, the golf ball may be picked up from the ground without effort with this golf club and the flagpole 31 may similarly be picked up.

I claim:

1. A golf club head having top and bottom sides and having a vertical shaft opening in said top side for receiving the end of a golf club shaft and extending lengthwise between a toe end and a heel end on opposite sides of the opening; a front generally vertically disposed surface that normally strikes a ball and extends upwardly from said bottom side, a rear surface opposite to the front surface having a ball-receiving cavity therein, said cavity being defined by an arcuate shaped rearwardly and upwardly opening surface that in a vertical direction extends from a rear edge of said bottom side to said top side, and in a lengthwise direction extends from said toe end rearwardly to the area of said shaft opening; and said heel end having converging side surfaces and an upwardly facing concave arcuate pole-engaging surface that begins adjacent the shaft opening and extends first downwardly and then outwardly to a relataively small tip at its distal end, the heel end further having an underside that extends lengthwise and downwardly from the tip to said bottom side so that said heel end may be shoved under a flagpole laying on the ground.

2. The golf club head as defined in claim 1 further characterized by the head having a marking thereon that may be viewed from above denoting the approximate center of weight distribution of the golf club head.

3. The golf club head as defined in claim 1 characterized by the toe having a tip and said cavity begins closely adjacent the tip and the bottom of the head so that there is a narrow lip at the tip and bottom of the head.

4. The golf club head as defined in claim 3 characterized by a rounded corner joining the tip and bottom and said lip extends around the corner.

5. A putter head having top and bottom sides and having vertical shaft opening in said top side for receiving the lower distal end of a golf club shaft and having a relatively flat forward and generally vertical side that normally strikes the golf ball and extends between said top and bottom sides and between a heel end positioned on one side of the shaft opening and a toe end positioned on the opposite side of the shaft opening, said head further having a concave ball-receiving cavity in the rear face of the putter head between the toe end and the shaft opening and between the top and bottom sides of the head, said bottom side being relatively wide and said top side being relatively wide at said shaft opening and from there narrowing to a relatively thin section between the toe end and shaft opening, and said cavity being defined by an arcuate surface that in a vertical direction extends from a rear edge of the relatively wide bottom side of the head to said relatively thin section of the top side, and in a lengthwise direction extends from a relatively thin lip at said toe end first forwardly and then rearwardly to the area of the head with the shaft opening therein; and said heel end having converging side surfaces and an upper arcuate side for receiving a pole and an underside that sweeps upwardly from said bottom of the head to join the upper arcuate side at a small tip at the distal end of said heel that may slide under a pole lying on the ground.

6. The invention defined in claim 5 further characterized by said head having an arcuate-shaped corner that joins the end of the toe and said bottom side and said lip extends vertically along the toe, along the corner and along the bottom of the shaft at the rear edge of the bottom side.

7. The invention defined in claim 5 further characterized by a surface marking on the head that is visible from above and denotes the center of weight distribution of the club.

* * * * *